US007081170B2

(12) United States Patent
Theurer et al.

(10) Patent No.: US 7,081,170 B2
(45) Date of Patent: Jul. 25, 2006

(54) METHOD OF CLEANING BALLAST

(75) Inventors: Josef Theurer, Vienna (AT); Manfred Brunninger, Altenberg (AT)

(73) Assignee: Franz Plasser Bahnbaumaschinen-Industriegesellschaft m.b.H, Vienna (AT)

( * ) Notice: Subject to any disclaimer, the term of this patent is extended or adjusted under 35 U.S.C. 154(b) by 113 days.

(21) Appl. No.: 10/457,198

(22) Filed: Jun. 9, 2003

(65) Prior Publication Data

US 2004/0011383 A1 Jan. 22, 2004

(30) Foreign Application Priority Data

Jul. 17, 2002 (AT) ..... GM476/2002

(51) Int. Cl.
*B08B 7/04* (2006.01)

(52) U.S. Cl. ..... 134/13; 134/18; 134/25.1; 134/25.5; 134/26; 134/32; 134/34; 134/36; 134/42; 210/800

(58) Field of Classification Search ..... 210/800; 134/18, 25.1, 25.5, 26, 32, 34, 36, 42, 13
See application file for complete search history.

(56) References Cited

U.S. PATENT DOCUMENTS

| | | | | |
|---|---|---|---|---|
| 4,595,506 | A * | 6/1986 | Kneer | 210/609 |
| 4,635,664 | A * | 1/1987 | Theurer et al. | 134/131 |
| 4,938,239 | A * | 7/1990 | Theurer et al. | 134/21 |
| 6,427,704 | B1 * | 8/2002 | Bleeker | 134/25.1 |
| 2002/0088758 | A1 * | 7/2002 | Blumenschein et al. | 210/712 |
| 2004/0011383 | A1 * | 1/2004 | Theurer et al. | 134/13 |

FOREIGN PATENT DOCUMENTS

GB 1 519 316 11/1978

* cited by examiner

*Primary Examiner*—Sharidan Carrillo
(74) *Attorney, Agent, or Firm*—Collard & Roe, P.C.

(57) ABSTRACT

A method of cleaning encrusted ballast comprises the steps of screening the encrusted ballast to separate detritus from the ballast, washing the screened ballast with water while removing the separated detritus on a conveyor belt unit, clarifying the washing water to produce a clarified water portion and washing water sludge, and disposing of the washing water sludge by moving it to the detritus on the conveyor belt unit for common removal with the detritus.

1 Claim, 1 Drawing Sheet

METHOD OF CLEANING BALLAST

BACKGROUND OF THE INVENTION

1. Field of the Invention

The present invention relates to a method of cleaning encrusted ballast supporting a track, which comprises the steps of screening the encrusted ballast to separate detritus from the ballast, and washing the screened ballast with water while removing the separated detritus on a conveyor belt unit.

2. Description of the Prior Art

British patent No. 1,519,316 discloses such a method. In this method, the washing water flows onto the track so that a very large amount of water is consumed.

SUMMARY OF THE INVENTION

It is the primary object of this invention to improve a method of cleaning ballast by screening and washing with water.

This is accomplished according to the invention by screening the encrusted ballast to separate detritus from the ballast, washing the screened ballast with water while removing the separated detritus on a conveyor belt unit, clarifying the washing water to produce a clarified water portion and washing water sludge, and disposing of the washing water sludge by moving it to the detritus on the conveyor belt unit for common removal with the detritus.

Depositing the washing water sludge on the detritus for common removal therewith has the advantage that the more or less liquid sludge forms a viscous mass with the detritus whereby the detritus serves as a carrier material for the sludge so that the sludge will not flow off but will be removed with the detritus to a storage car. This does away with costly conveying and storing units for the washing weater sludge.

BRIEF DESCRIPTION OF THE DRAWING

The above and other objects, advantages and features of the invention will become more apparent from the following detailed description of a now preferred embodiment, taken in conjunction with the accompanying, somewhat schematic drawing wherein.

DETAILED DESCRIPTION OF THE PREFERRED EMBODIMENT

Figure 1:
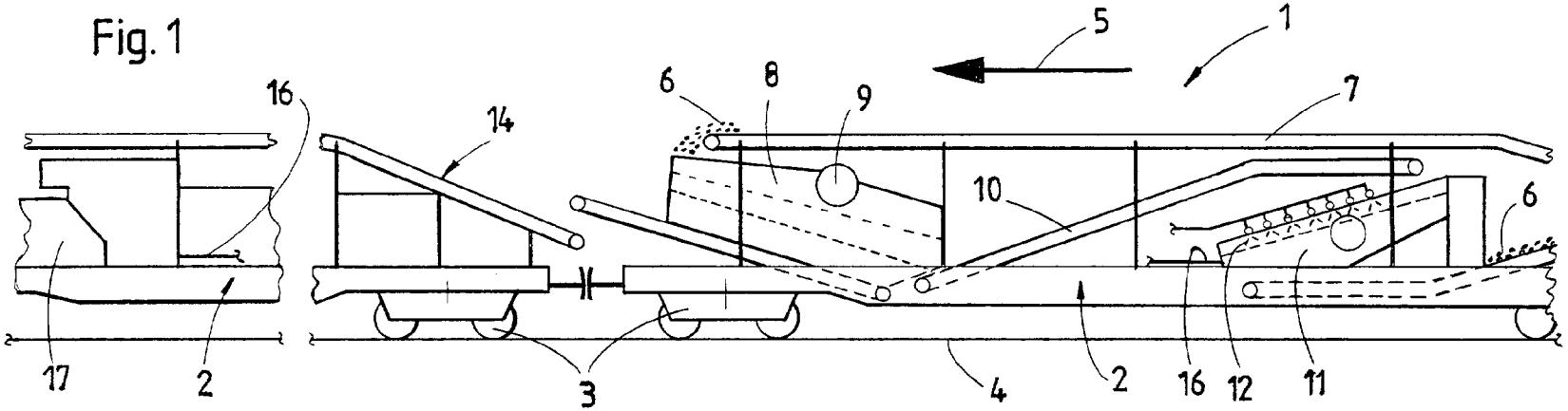
FIGS. 1 and 2 show a side view of a generally conventional ballast cleaning machine, FIG. 2 being the continuation of FIG. 1.
Figure 2:
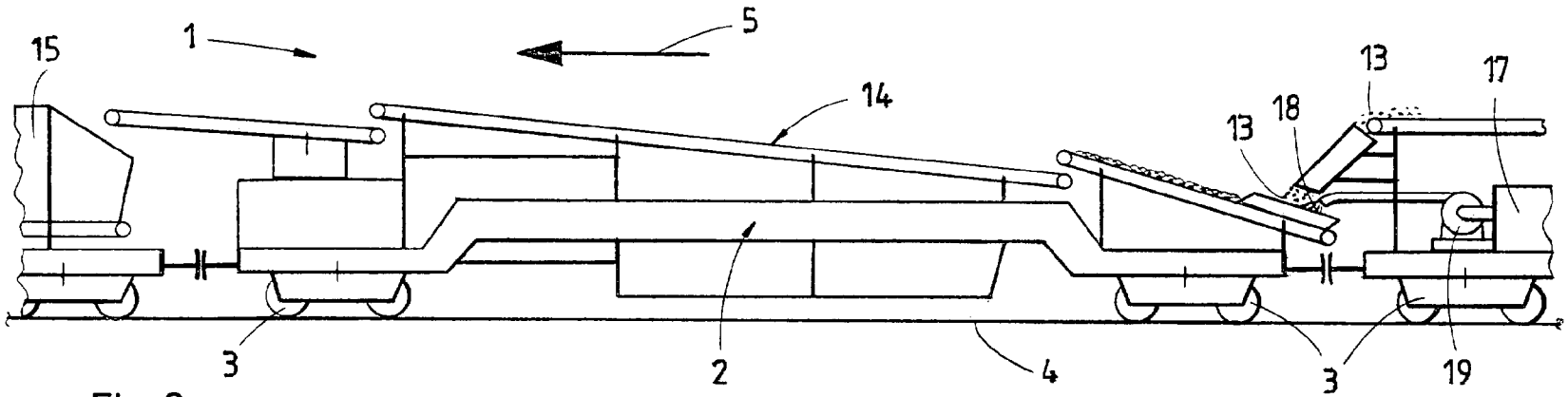

Referring to the drawing, there is shown the portion of ballast cleaning machine 1 which involves the method of the present invention. The machine is comprised of a number of cars 2 coupled to each other and supported by undercarriages 3 for movement on track 4 in an operating direction indicated by arrow 5. As is well known, encrusted ballast 6 supporting track 4 is removed from underneath the track by an endless excavating chain (not shown), and the excavated encrusted ballast is conveyed by conveyor belt 7 to screening unit 8, which is vibrated by vibrator 9, and where the encrusted ballast 6 is screened to separate detritus 13 from the ballast.

The mechanically screened ballast is conveyed by conveyor belt 10 to wash installation 11 where it is washed with water 12 sprayed onto the screened ballast. The doubly-cleaned ballast 6 is then returned to the track in a manner well known and not illustrated herein.

At the same time and while the screened ballast is washed, the separated detritus 13 is removed from screening unit 8 on conveyor belt unit 14, which conveys the detritus to a storage car 15. Washing water 12 is pumped from wash installation 11 through conduit 16 to water clarifying installation 17 where the washing water is clarified to produce a clarified water portion and washing water sludge 18. This washing water sludge is disposed by pumping it by pump 19 to detritus 13 on conveyor belt unit 14 where it is removed with the detritus to storage car 15. The detritus serves as a carrier material for the liquid washing water sludge during the conveyance on conveyor belt unit 14. Flow-off of washing water sludge 18 from conveyor belt unit 14 can be avoided by properly metering the pumped amount of washing water sludge in dependence on the consistency of detritus 13.

What is claimed is:

1. A method of cleaning encrusted ballast supporting a track, which comprises the steps of (a) screening the encrusted ballast to separate detritus from the ballast, (b) washing the screened ballast with water while removing the separated detritus on a conveyor belt unit, (c) clarifying the washing water to produce a clarified water portion and washing water sludge, and (d) disposing of the washing water sludge by moving it to the detritus on the conveyor belt unit for common removal with the detritus.

* * * * *